US007832121B2

(12) United States Patent
Ishak

(10) Patent No.: US 7,832,121 B2
(45) Date of Patent: Nov. 16, 2010

(54) FOOTWEAR WITH DEPLOYABLE CRAMPONS

(76) Inventor: Alec Andrew Ishak, 2516 Palmer View Dr., Bel Air, MD (US) 21015

( * ) Notice: Subject to any disclaimer, the term of this patent is extended or adjusted under 35 U.S.C. 154(b) by 868 days.

(21) Appl. No.: 11/715,770

(22) Filed: Mar. 8, 2007

(65) Prior Publication Data

US 2007/0209236 A1 Sep. 13, 2007

Related U.S. Application Data

(60) Provisional application No. 60/780,314, filed on Mar. 8, 2006.

(51) Int. Cl.
*A43C 15/14* (2006.01)

(52) U.S. Cl. ..... 36/61

(58) Field of Classification Search ..... 36/61, 36/134, 59 R, 67 D
See application file for complete search history.

(56) References Cited

U.S. PATENT DOCUMENTS

| | | | | | |
|---|---|---|---|---|---|
| 48,943 | A * | 7/1865 | Hodgins | 36/75 R |
| 264,105 | A * | 9/1882 | Rust | 36/61 |
| 691,857 | A * | 1/1902 | Hansen | 36/41 |
| 919,082 | A * | 4/1909 | Schaney | 36/61 |
| 1,361,078 | A * | 12/1920 | Lynn | 36/61 |
| 2,078,626 | A * | 4/1937 | Bauer | 36/35 R |
| 4,335,529 | A * | 6/1982 | Badalamenti | 36/59 R |
| 4,375,729 | A | 3/1983 | Buchanen | |
| 4,524,531 | A * | 6/1985 | VanDeripe | 36/127 |
| 4,525,939 | A | 7/1985 | McNeil et al. | |
| 4,748,753 | A * | 6/1988 | Ju | 36/127 |
| 5,265,354 | A * | 11/1993 | Aliano, Jr. | 36/127 |
| 5,289,647 | A * | 3/1994 | Mercer | 36/134 |
| 5,809,668 | A | 9/1998 | Kiniry et al. | |
| 5,870,838 | A * | 2/1999 | Khayat | 36/61 |
| 6,058,627 | A | 5/2000 | Violette et al. | |
| 6,453,581 | B1 | 9/2002 | Kiniry et al. | |
| 6,813,847 | B2 | 11/2004 | Workman | |
| 6,964,118 | B2 | 11/2005 | Parisotto et al. | |
| 7,430,819 | B2 * | 10/2008 | Auger et al. | 36/134 |
| 2002/0078598 | A1 | 6/2002 | Bell | |

* cited by examiner

*Primary Examiner*—Ted Kavanaugh
(74) *Attorney, Agent, or Firm*—Ober, Kaler, Grimes & Shriver; Royal W. Craig

(57) ABSTRACT

An improved boot for use in ice and snow conditions that combines a flared snowshoe-like secondary sole with integral and selectively deployable crampons. The expanded secondary sole extends approximately ¼" or more down from the primary sole of the boot and includes retractable crampons attached to the expanded sole to increase traction in snow or ice. The expanded sole functions to increase the surface area of the "footprint", thereby reducing the overall depth of the footprint and making traversing in soft conditions (snow, mud, sand) less fatiguing to the wearer. The crampons may pivot outward from inside pockets in the secondary sole or, alternatively, may slide outward in a stiletto-fashion and/or unfold. The crampons may be individually deployable or simultaneously deployable by a central release button.

8 Claims, 3 Drawing Sheets

FOOTWEAR WITH DEPLOYABLE CRAMPONS

CROSS-REFERENCE TO RELATED APPLICATIONS

The present application derives priority from U.S. provisional application Ser. No. 60/780,314 filed Mar. 8, 2006.

BACKGROUND OF THE INVENTION

1. Field of the Invention

The present invention relates to footwear for use in ice and snow conditions and, more particularly, to footwear with integral and selectively deployable crampons.

2. Description of the Background

Safety experts agree that many injuries result from falls on ice covered surfaces. Medical evidence shows that in Ontario, Canada 11,919 people had to go to the emergency room in the winter of year 2002-2003 because of injuries related to falls on ice. Of these visits 17% of them had to stay one night in the hospital. Most people who had to stay overnight were aged 60 to 79. On average a person over 80 years of age must stay in the hospital 14.5 days after a fall on the ice. Currently to walk or hike in varying winter conditions one needs a quality boot plus a spike or crampon attachment for safely traversing ice conditions, and/or a snowshoe to reduce human fatigue in snow by reducing the footprint depth.

Crampons are spikes that are strapped on to the bottom of mountaineering boots for traction on snow and ice. They have points protruding downwards about an inch in length. There are several types of conventional crampons. Strap-on crampons, use a combination of toe and heel caps to secure the crampon on the boot. Pneumatic crampons have a toe cap (usually made of plastic) and a lever that fits into a heel welt to ensure a tight fit. U.S. Pat. No. 6,964,118 describes crampons that are placed on the sole of a boot to provide extra grip on ice and steep slopes.

Snowshoes typically include a strap-on binding similar to the foregoing crampons.

In both cases the crampons and snowshoes are not easy to apply and not always convenient. The current inventor finds them inconvenient, time consuming, and expensive. It would be greatly advantageous to provide footwear with expanded soles and integral selectively-deployable crampons to avoid the foregoing problems.

U.S. Pat. No. 6,813,847 shows a boot with replaceable soles. Each sole is designed to grip better on different surfaces.

U.S. Pat. No. 5,809,668 shows a composite snowshoe to make walking in the snow easier and less tiring. This snowshoe includes a crampon on the bottom to provide extra grip.

U.S. Pat. No. 4,525,939 shows a boot with a non-slipping attachment. Both the toe and heel parts of the boot have the non-slip attachment.

Application No. 20020078598 shows cleats that have multilevel gripping spikes.

The shortcomings of the foregoing and all other known prior art include: inconvenience, time consumption, and expense. For safe traversing on ice, a gripping sole attachment should be used. However one must first attach this to the boot. For snow, the grip attachment must be removed and a snowshoe should be utilized. This is also inconvenient since the ice attachment needs to be removed and the snowshoe added. Furthermore, one must purchase three items (boot, grip attachment, snowshoe) to safely traverse in outdoor winter conditions. This can be expensive.

It would be greatly advantageous to provide a boot with integral snowshow sole and crampons combined in one final, convenient product that not only provides convenience, but safety as well.

SUMMARY OF THE INVENTION

It is therefore an object of the present invention to provide a boot for use in ice and snow conditions that combines a flared snowshoe-like secondary sole with integral and selectively deployable crampons.

It is another object to employ an expanded sole to increase the surface area of the "footprint", thereby reducing the overall depth of the footprint and making traversing in soft conditions (snow, mud, sand) less fatiguing to the wearer.

It is another object to provide a boot for use in ice and snow as described above with an expanded secondary sole that extends approximately ½ in. or more from the primary sole of the boot and includes retractable crampons attached to the expanded sole to increase traction in snow or ice.

In accordance with the foregoing objects, the present invention is a boot for use in ice and snow conditions that combines a flared snowshoe-like secondary sole with integral and selectively deployable crampons. The expanded secondary sole extends approximately ½ in. or more from the primary sole of the boot and includes retractable crampons attached to the expanded sole to increase traction in snow or ice. The expanded sole functions to increase the surface area of the "footprint", thereby reducing the overall depth of the footprint and making traversing in soft conditions (snow, mud, sand) less fatiguing to the wearer. The crampons may pivot outward from inside pockets in the secondary sole or, alternatively, may slide outward in a stiletto-fashion and unfold. The crampons may be individually deployable or simultaneously deployable by a central release button.

BRIEF DESCRIPTION OF THE DRAWINGS

Other objects, features, and advantages of the present invention will become more apparent from the following detailed description of the preferred embodiment and certain modifications thereof when taken together with the accompanying drawings in which.

DETAILED DESCRIPTION OF THE PREFERRED EMBODIMENTS

The present invention is a boot for use in ice and snow conditions that combines a flared snowshoe-like secondary sole with integral and selectively deployable crampons. The expanded secondary sole extends approximately ½ in. or more from the primary sole of the boot and includes retractable crampons attached to the expanded sole to increase traction in snow or ice. The expanded sole functions to increase the surface area of the "footprint", thereby reducing the overall depth of the footprint and making traversing in soft conditions (snow, mud, sand) less fatiguing to the wearer.

Figure 1:
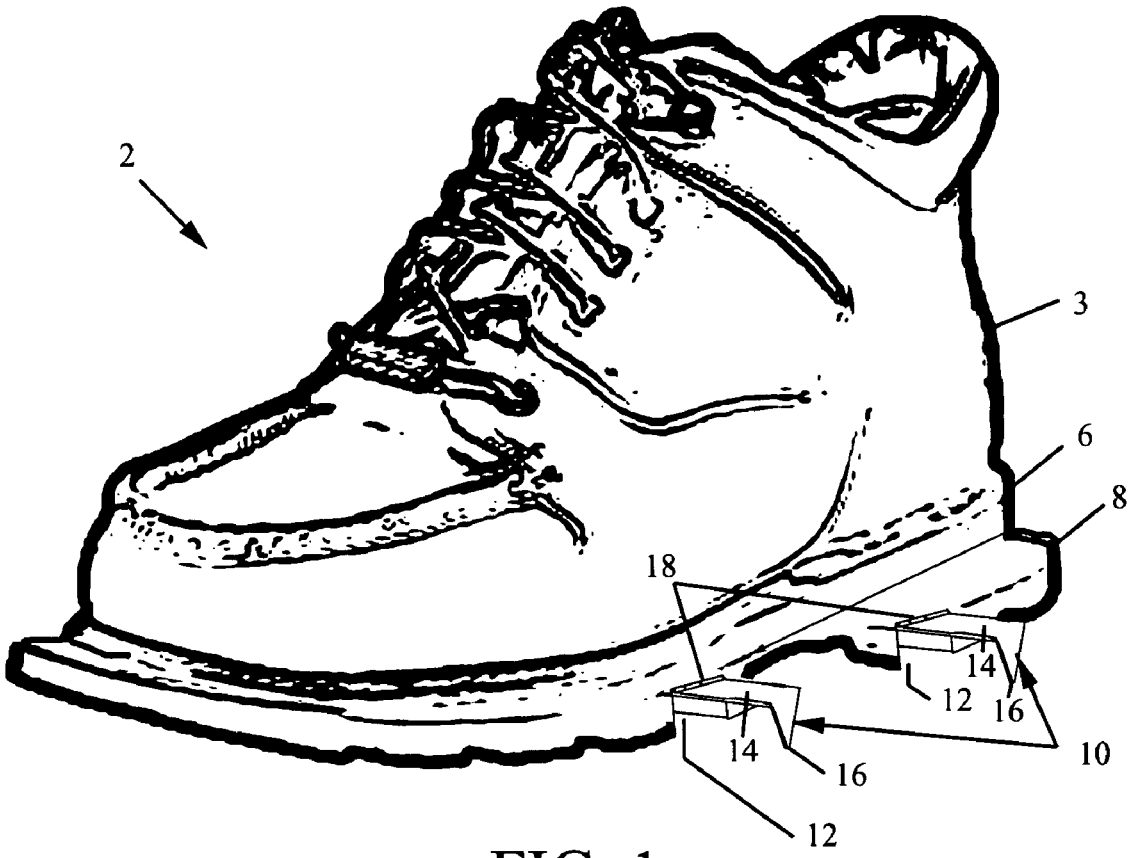
FIG. 1 is a perspective view of a boot 2 with expanded secondary sole 8 plus integral and selectively deployable crampons 10 according one embodiment of the present invention.

FIG. 1 is a perspective view of a boot 2 with expanded secondary sole 8 plus integral and selectively deployable crampons 10 according one embodiment of the present invention.

Figure 2:
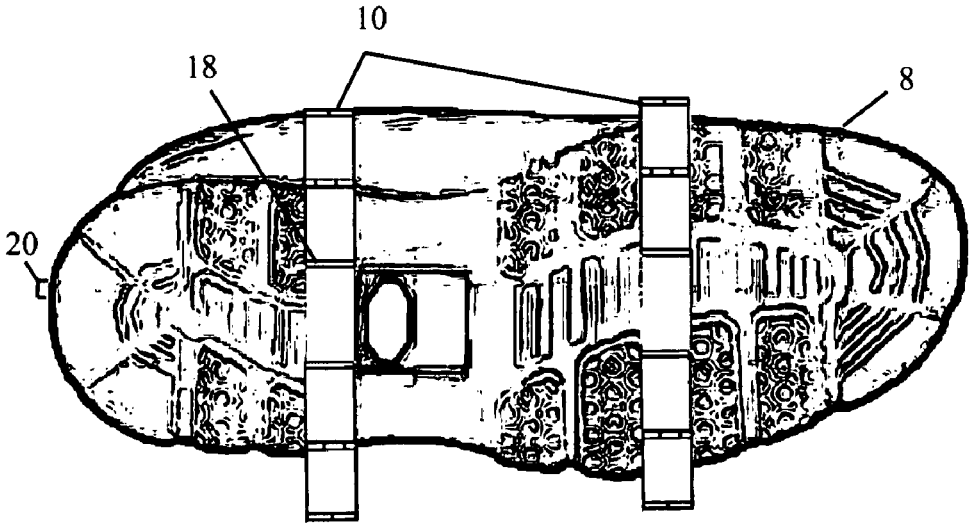
FIG. 2 is a bottom view of the boot 2 as in FIG. 1.

FIG. 2 is a bottom view of the boot 2 as in FIG. 1.

With combined reference to FIGS. 1 and 2, the boot 2 includes an upper 3 that may take a variety of conventional forms, the illustrated hiking boot being just one. The upper 3 may be waterproof, insulated, non-insulated, or even scent-proof.

Boot 2 also includes a primary sole 6 attached in a conventional manner to the upper 3. In accordance with the present invention, an extended secondary sole 8 is attached beneath the primary sole 6. As indicated above, the secondary sole 8 has two distinct features: 1) it extends peripherally approximately ½ in. (or more) outward past the primary sole 6 of the boot; and 2) the secondary sole 8 includes manually retractable crampons 10 pivotally attached along the sides of the expanded secondary sole 8 to increase traction in snow or ice. In the illustrated embodiment four retractable crampons 10 are included, although more or fewer (such as two) may suffice. Each crampon 10 is manually retractable into a lateral pocket 12 formed in the secondary sole 8. Each crampon further includes a horizontal strut 14 pivotally connected at a spring-loaded locking hinge 18 to the secondary sole 8. The horizontal strut extends outward to substantially vertical tooth 16. In the deployed position (shown) the horizontal strut 14 extends approximately ½" to 1" outward from the secondary sole 8 to the downwardly extending vertical tooth 16, which tooth 16 extends downward approximately ¼" beneath the plane of the secondary sole 8. To stow the crampons 10 they are manually pivoted inward and upward and are locked in a folded position with the horizontal strut 14 seated in the lateral pocket 12 and the tooth protruding up into a deeper channel 18 at the inner end of pockets 12. The crampons 10 may be locked/unlocked manually at the hinges or, alternately, lock/release buttons such as 20 may be provided at the heel of the boot 2 to deploy all the crampons 10 simultaneously.

The advantage of the foregoing boot 2 is that it integrates footwear, grip (crampons 10), and a snowshoe function (extended secondary sole 8) all in one boot 2, resulting in multifunctional and convenient footwear.

Figure 3:
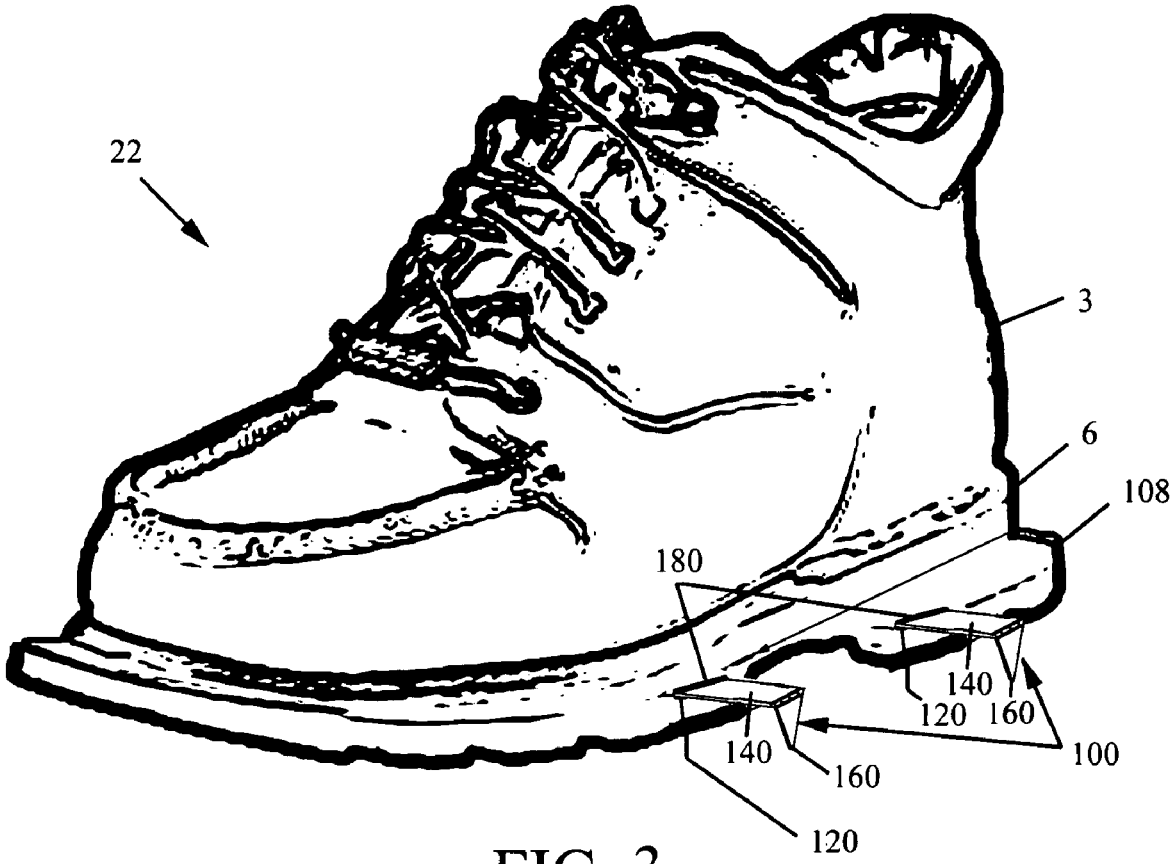
FIG. 3 is a perspective view of a boot 120 with stiletto-style deployable crampons 100 according to another embodiment of the present invention.
Figure 4:
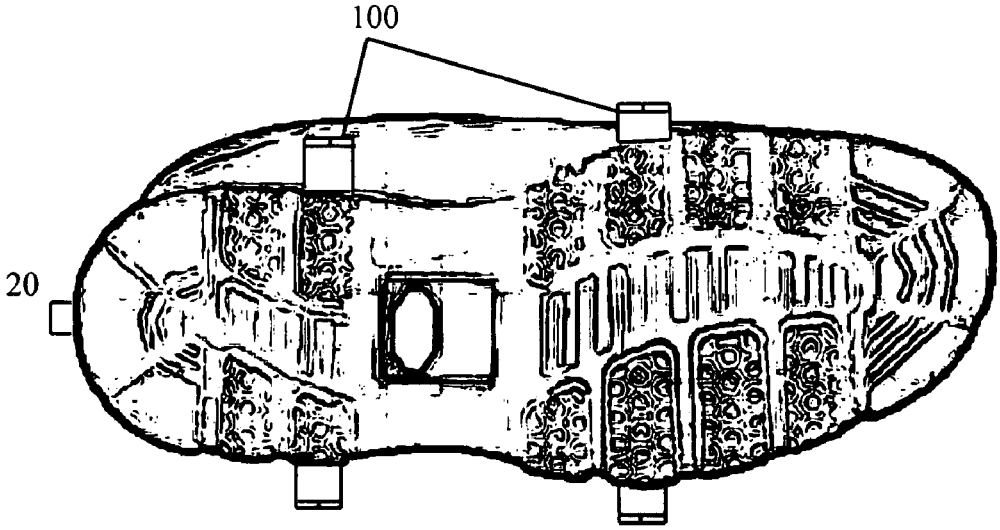
FIG. 4 is a bottom view of the boot 120 as in FIG. 3.

FIG. 3 is a perspective view of a boot 120 with stiletto-style deployable crampons 100 according to another embodiment of the present invention. The stiletto-style deployable crampons 100 slide sidelong outward from inside the expanded secondary sole 8, and the tooth 160 of each crampon 100 then pivots downward. FIG. 4 is a bottom view of the boot 120 as in FIG. 3. With combined reference to FIGS. 3 and 4, the boot 120 includes an upper 3 as described above, and primary sole 6 attached in a conventional manner to the upper 3. An extended secondary sole 108 is attached beneath the primary sole 6. The secondary sole 108 has two distinct features: 1) it extends peripherally approximately ½ in. (or more) outward past the primary sole 6 of the boot; and 2) the secondary sole 8 includes slidably-retractable crampons 100 that are spring-loaded into grooves 120 formed alongside the sides of the expanded secondary sole 8 to increase traction in snow or ice. In the illustrated embodiment four retractable crampons 100 are included, although more or fewer (such as two) may suffice. Each crampon 100 is retractable into a lateral groove 120 formed in the side of the secondary sole 8. Each crampon 100 further includes a horizontal strut 140 pivotally connected at a spring-loaded locking hinge to a vertical tooth 160. When the hinge is unlocked the tooth 160 folds flat against strut 140, and this allows the tooth 160 and strut 140 together to be slidably loaded back into the lateral grooves 120 formed in the side of the secondary sole 8. To deploy the crampons 100, a button 20 is pressed to unlock them and they deploy outward automatically in stiletto fashion, the spring hinge biasing the teeth 160 downward into the deployed position (shown) with the horizontal strut 140 extending approximately ½" to 1" outward from the secondary sole 108 to the downwardly extending vertical tooth 160, which tooth 160 extends downward approximately ¼" beneath the plane of the secondary sole 108. This boot 22 has the same advantages described above in regard to boot 2 in that it integrates footwear, grip (crampons 100), and a snowshoe function (extended secondary sole 8) all in one boot.

In still other embodiments the crampons may comprise spikes that deploy directly downward around the periphery of the secondary sole.

Figure 5:
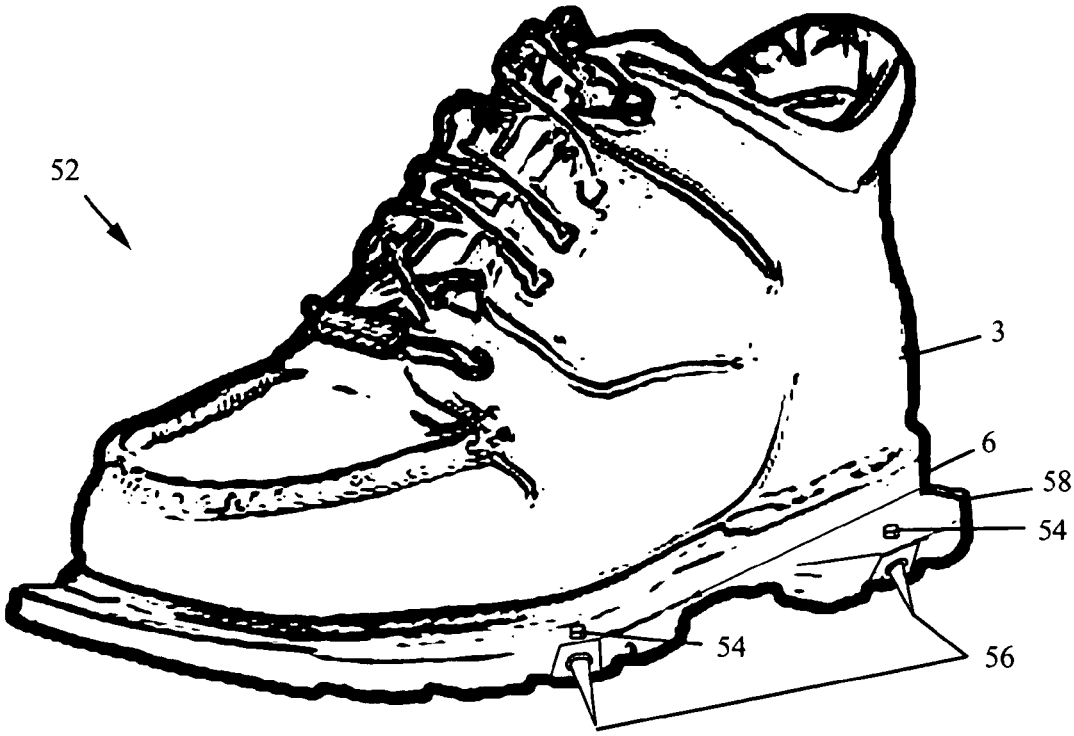
FIG. 5 is a perspective view of a boot 52 with another embodiment of stiletto-style deployable crampons 56.
Figure 6:
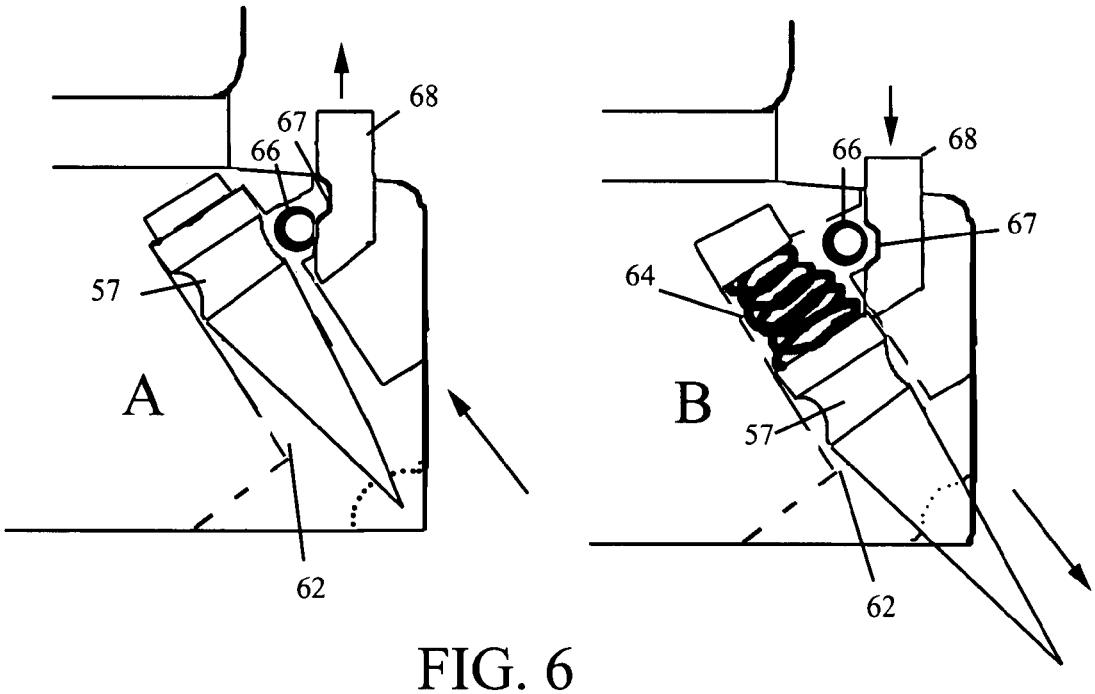
FIG. 6 is a partial side cross-section of the boot 52 illustrating crampons 56 as in FIG. 5 with internal components.

For example, FIG. 5 is a perspective view of a boot 52 with another embodiment of stiletto-style deployable crampons 56, and FIG. 6 is a partial side cross-section illustrating crampons 56 as in FIG. 5 with internal components.

Boot 52 likewise includes a primary sole 6 attached in a conventional manner to the upper 3, and an extended secondary sole 58 attached beneath the primary sole 6. The secondary sole 58 extends peripherally approximately ½ in. (or more) outward past the primary sole 6 of the boot, and also includes manually retractable crampons 56 that deploy from the sides of the expanded secondary sole 58 to increase traction in snow or ice. The crampons 56 may deploy perpendicularly or obliquely. In the illustrated embodiment four retractable crampons 56 are included, although more or fewer (such as two) may suffice. Each crampon 56 is manually retractable into an aperture 62 formed in the secondary sole 8. Each crampon 56 is formed as a spike with an annular concave ring 57 about the top. Each crampon 56 is also spring loaded into the secondary sole by a compression spring 64. A detent ball 66 abuts the crampon 56 body and may be selectively retracted to free the crampon 56 and allow the spring bias to eject the crampon 56 stiletto-style outward so that the sharp spiked tip protrudes from the secondary sole 58. The detent ball 66 is itself retracted by a pushbutton 68 located atop the secondary sole 58, one button 68 proximate each crampon 56. The pushbutton 68 includes a pin body having formed with an alcove 67 into which the ball 66 can retract when the pushbutton 68 is depressed, thereby freeing the crampon 56 to eject outward. The pushbutton 68 preferably includes a housing or sleeve inserted into the secondary sole for receiving the pin body, and especially providing a collar for the pin body about the top of the secondary sole 58 to prevent fouling by dirt, moisture or debris.

The pushbutton 68 may also be formed with a downward protrusion as shown to lock the crampon 56 in the downwardly ejected position. The pushbutton 68 is preferably a detent-type button able to return to its original position upon a second push, and this urges ball 66 out of the alcove 67 where it is positioned to intrude into the annular concave ring 57 about the top of the crampon 56, thereby locking it in its retracted position. Again, in a deployed position the crampons 56 preferably extend at least ¼" beneath a plane of the sole. Thus, in operation of the foregoing embodiment, all four retractable crampons 56 begin in a first (home) position as seen at FIG. 6A with the spring 64 compressed, crampon 56 is fully retracted into aperture 62 formed in the secondary sole 8, detent ball 66, pushbutton 68 biased outward so that ball 66 is forced into the alcove 67 where it is positioned to lock the crampon 56 in its retracted position. Conversely, depressing the pushbutton 68 as shown at FIG. 6B allows the ball 66 into the alcove 67 where it is positioned to free the crampon 56 and allow it to extend via spring 64 to a second (deployed) position. The downward protrusion of pushbutton 68 locks the crampon 56 in the downwardly ejected position. However, pressing the pushbutton 68 a second time pops it back to the position of FIG. 6A and allows the wearer to manually retract the crampons 56 to their home position as seen in FIG. 6A simply by stepping them against a hard surface. It may also be desirable to employ a single lock/release buttons for all the crampons 56.

Having now fully set forth the preferred embodiments and certain modifications of the concept underlying the present invention, various other embodiments as well as certain variations and modifications thereto may obviously occur to those skilled in the art upon becoming familiar with the underlying concept. It is to be understood, therefore, that the invention may be practiced otherwise than as specifically set forth herein.

I claim:

1. Footwear comprising:

a sole attached to an upper for wearing on the foot, said sole extending peripherally outward past said upper;

a plurality of selectively deployable crampons housed in the sole and extendable there from to increase traction in snow or ice, said plurality of selectively deployable crampons each set in a corresponding aperture within said sole and spring-biased away from a retracted position fully enclosed in said sole toward a deployed position extending downward from said sole through said aperture;

a plurality of detents housed in said sole each adjacent a corresponding crampon for selectively locking said crampon in said retracted position and releasing said crampon to said deployed position;

at least one pushbutton mounted on said sole in operative engagement with said plurality of detents for manually unlocking said detents from said crampons for deployment of said crampons stiletto-style downward through said apertures.

2. The footwear according to claim 1, wherein in said deployed position the crampons extend at least ¼" beneath a plane of the sole.

3. The footwear according to claim 2, wherein said at least one pushbutton further comprises a plurality of pushbuttons each corresponding to one of said plurality of selectively deployable crampons for individually deploying said crampons.

4. A boot comprising:

a primary sole attached to an upper for wearing on the foot;

a secondary sole attached beneath said primary sole and extending peripherally outward past said primary sole;

a plurality of retractable stiletto-like crampons housed in the secondary sole and extendable there from to increase traction in snow or ice, said plurality of crampons each set in a corresponding aperture within said secondary sole and spring-biased away from a retracted position fully enclosed in said secondary sole toward a deployed position extending downward from said secondary sole through said aperture;

a pushbutton mounted on said secondary sole in cooperation with said plurality of crampons for selectively locking said crampons in said retracted position and unlocking said crampons for deployment stiletto-style downward through said apertures.

5. The boot according to claim 4, wherein said plurality of selectively deployable crampons are each slidably inserted into channels in said secondary sole to stow the crampons.

6. The boot according to claim 4, wherein in said deployed position each of said plurality of retractable stiletto-like crampons extends downward by at least ¼" beneath a plane of the secondary sole.

7. The boot according to claim 4, further comprising a plurality of detents housed in said secondary sole each adjacent a corresponding crampon and movable by said pushbutton into and out from engagement with said corresponding crampon for selectively locking said crampon in said retracted position and releasing said crampon to said deployed position.

8. The boot according to claim 7, further comprising a plurality of pushbuttons each corresponding to one of said plurality of selectively deployable crampons for individually deploying said crampons.

* * * * *